US008342508B2

(12) United States Patent
Wild et al.

(10) Patent No.: US 8,342,508 B2
(45) Date of Patent: Jan. 1, 2013

(54) SYSTEM FOR TRANSFERRING OBJECTS

(75) Inventors: Hans-Peter Wild, Eppelheim (DE); Frank Lechert, Weinheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 515 days.

(21) Appl. No.: 12/398,492

(22) Filed: Mar. 5, 2009

(65) Prior Publication Data

US 2009/0250866 A1 Oct. 8, 2009

(30) Foreign Application Priority Data

Mar. 6, 2008 (EP) ..... 08004208

(51) Int. Cl.
*B65H 3/08* (2006.01)

(52) U.S. Cl. ..... 271/103; 271/93; 271/90; 271/100; 271/107; 271/99; 493/313; 493/315

(58) Field of Classification Search ..... 271/103, 271/90, 93, 100, 107, 99, 95, 91, 102
See application file for complete search history.

(56) References Cited

U.S. PATENT DOCUMENTS 3,176,978 A * 4/1965 Baker et al. ..... 271/5
3,534,667 A * 10/1970 Krause ..... 493/310
4,081,945 A * 4/1978 Calvert et al. ..... 53/566
4,155,546 A * 5/1979 Jacobs ..... 271/11
4,566,846 A * 1/1986 Cartwright ..... 414/742
4,605,393 A * 8/1986 Krieger et al. ..... 493/317
4,881,934 A * 11/1989 Harston et al. ..... 493/315
5,052,672 A * 10/1991 Horii ..... 271/9.05
5,511,772 A * 4/1996 Ganz et al. ..... 271/12
5,536,135 A 7/1996 Robertson
5,676,519 A * 10/1997 Canziani et al. ..... 414/798.9

(Continued)

FOREIGN PATENT DOCUMENTS

DE 102005017962 A1 10/2006

(Continued)

OTHER PUBLICATIONS

European Search Report from the European Patent Office for European Patent Application No. 08 00 4208.

(Continued)

*Primary Examiner* — Luis A Gonzalez
(74) *Attorney, Agent, or Firm* — Stroock & Stroock & Lavan LLP

(57) ABSTRACT

A system for transporting an object between stations, for example, from a magazine to a conveyor is provided having a rotary apparatus having two arms, wherein a first arm rocks back and forth between two positions and a second arm rotates about an axis on the first arm. The second arm can be fixedly connected to a holder having one or more suction heads for grasping the object. Preferably, the holder is arranged parallel to the object and moved in a direction perpendicular to the plane of the object as the object is removed from the magazine. Additionally, the holder is preferably displaced above the conveyor and positioned to be parallel to the conveyor, after which the holder is moved toward the conveyor in a path that is perpendicular to the plane of the conveyor. Therefore, the lateral force, shearing force, and friction exerted on the object during removal from the magazine and deposition onto the conveyor can be minimized.

9 Claims, 7 Drawing Sheets

U.S. PATENT DOCUMENTS

| | | | | |
|---|---|---|---|---|
| 6,168,149 | B1 * | 1/2001 | Boldrini | 271/107 |
| 6,231,040 | B1 * | 5/2001 | Langenegger | 271/107 |
| 7,040,479 | B2 * | 5/2006 | Fochler et al. | 198/409 |
| 7,695,421 | B2 * | 4/2010 | Ford | 493/315 |
| 2008/0227612 | A1 * | 9/2008 | Harston | 493/315 |

FOREIGN PATENT DOCUMENTS

| | | |
|---|---|---|
| EP | 0949148 | 10/1999 |
| FR | 2686531 | 7/1993 |
| WO | WO01/58761 | 8/2001 |
| WO | 2006/111309 A1 | 10/2006 |

OTHER PUBLICATIONS

Office Action issued on Apr. 11, 2011 in Canadian Patent Appln. No. 2,650,367.

* cited by examiner

SYSTEM FOR TRANSFERRING OBJECTS

BACKGROUND OF THE INVENTION

This invention relates, in general, to a system for moving objects, such as cartons, packaging blanks, single or multiple sheets, plastic bags, etc., from a source, such as a magazine of objects, to a station, such as a conveyor belt.

Many objects require handling with care because of the low material strength of the object, such as sheet-type objects. For example, a carton blank, whereas it usually consists of two or multiple layers, poses risk of being damaged. The risk often increases as the speed at which the objects are handled increases. Packaging machines for packing filled beverage bags into boxes is a non-limiting example of a situation in which objects are handled at high speed and at risk of being damaged.

In light of the shortcomings described above, it is desirable to provide an apparatus and method for facilitating transporting objects between stations.

SUMMARY

Generally speaking, the present invention is directed toward a system for transporting an object between stations. For example, an apparatus can transport an object, such as a sheet-like object, from a source, such as a stack, magazine, etc. to a destination, such as a station, a conveyor, for example, one or more conveyor belts. Preferably, the lateral force, shearing force and/or friction exerted on the object as the object is withdrawn from the source is minimized, most preferably eliminated.

In accordance with an embodiment of the invention, the object is deposited at the destination, for example, on the conveyor belt, in a substantially straight-lined movement, such that the lateral force, shearing force and friction exerted on the object as the object is received at the destination is minimized, most preferably eliminated.

Preferably, the system includes holders pivotally connected to a rotating arm, which is preferably rotated back and forth between two positions. A crank mechanism can be provided to control the movement of the rotating arm, and a separate drive can control the pivoting motion of the holders.

A method for transporting an object between stations is also provided. An embodiment of the method can include removing the object from its source in a direction substantially perpendicular to the plane of the object. The method can include rotating the object as it is transported toward the receiving surface of the destination until the object is above the receiving surface and the plane of the object is parallel to the receiving surface. The object is preferably lowered onto the surface in a direction substantially perpendicular to the receiving surface so as to maintain the plane of the object parallel to the receiving surface.

An object of the invention is to provide an improved system and method for transporting containers as described herein.

Other objects and features of the present invention will become apparent from the following detailed description, considered in conjunction with the accompanying drawing figure. It is to be understood, however, that the drawings are designed solely for the purpose of illustration and not as a definition of the limits of the invention, for which reference should be made to the appended claims.

BRIEF DESCRIPTION OF THE FIGURES

For a fuller understanding of the invention, reference is had to the following description, taken in connection with the accompanying drawings, in which.

DETAILED DESCRIPTION

Figure 1:
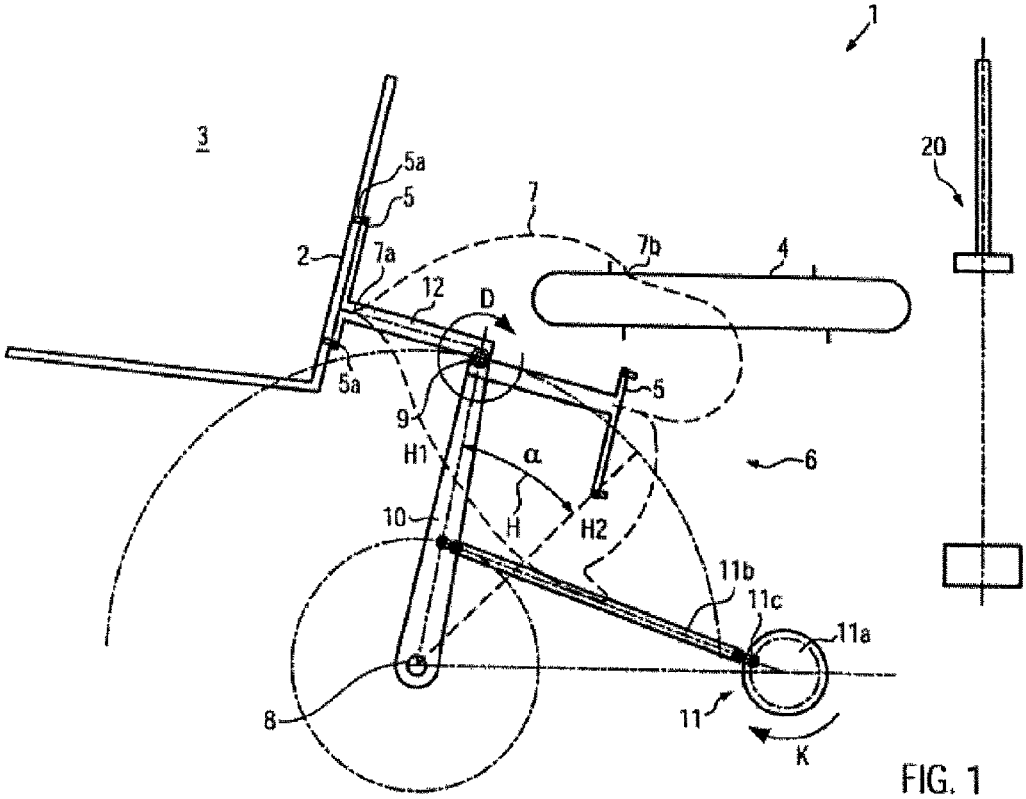
FIG. 1 is a cross sectional view of a portion of a transfer apparatus in accordance with an embodiment of the invention.

Reference is made to FIG. 1, wherein a schematic diagram of a system 1 for transferring an object 2 is shown. In the embodiment illustrated, an object 2 is removed from a first location, for example, a source 3 to a second location, for example, a destination 4. Whereas a variety of objects 2 are contemplated, embodiments of object 2 can have a generally flat, sheet like shape, in one or more layers, folded, unfolded, or any variation thereof. By way of non-limiting example, object 2 can be carton blanks for packing containers, such as beverage containers, more particularly, for packing beverage bags.

In accordance with an exemplary embodiment, source 3 can include a stock, for example, a magazine in which a plurality of objects 2 are stacked, arranged in a row, etc. In accordance with an exemplary embodiment of system 1, each object 2 is arranged on its edge, which may minimize the height of the stack of objects 2. Such an arrangement may also facilitate refilling the magazine.

Figure 1A:
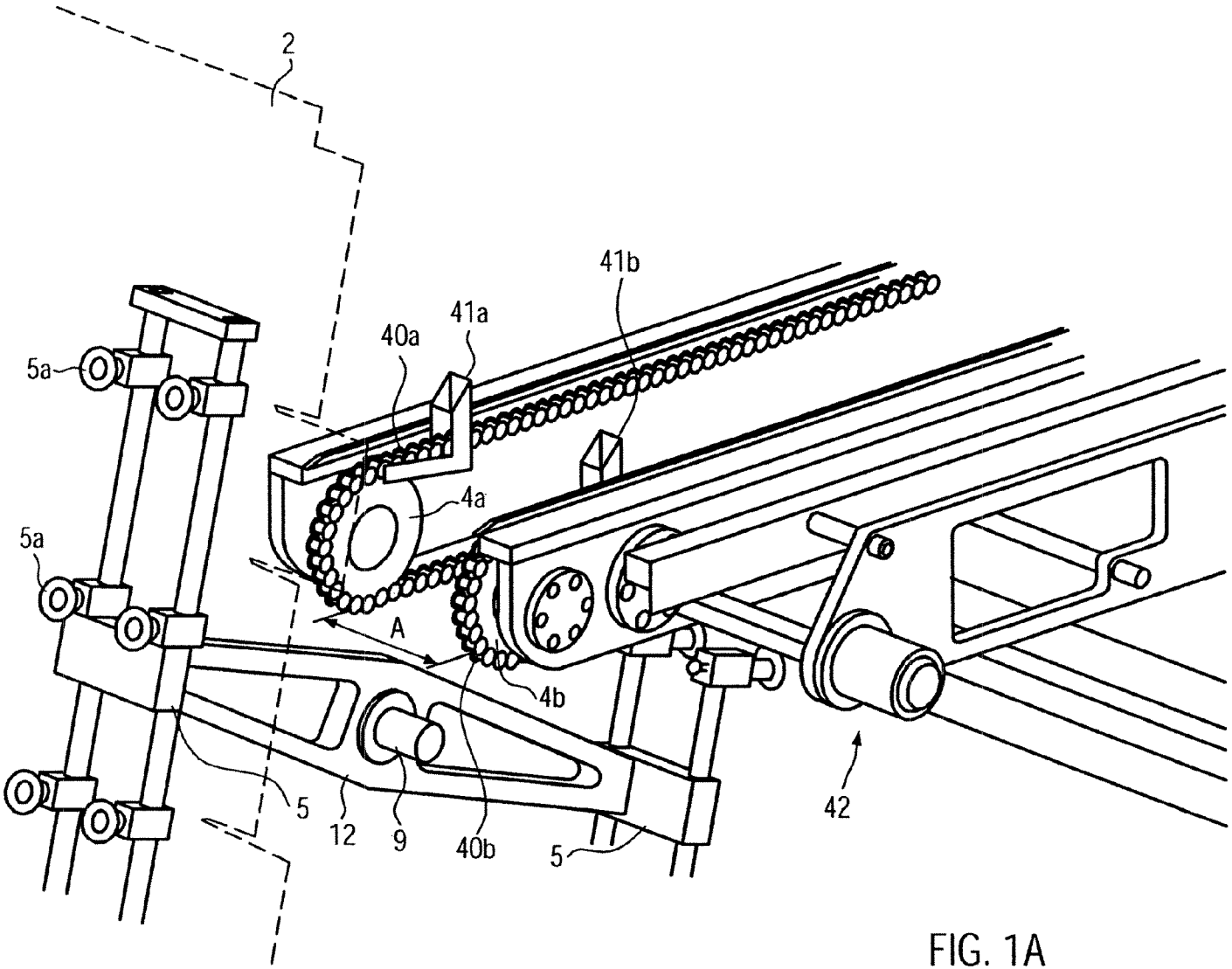
FIG. 1A is a perspective representation of the conveyor shown in FIG. 1.

Destination 4 can include a conveyor, such as a conveyor belt onto which object 2 can be laid and transferred to another station, a stage, apparatus, etc. For example, object 2 can be transferred to a shaping or erecting machine 20 for shaping or erecting cartons, as represented schematically in FIG. 1. Referring to FIG. 1A, destination 4 can include two conveyor belts 4*a*, 4*b*, preferably positioned parallel to each other, having a gap A therebetween. Preferably, at least one conveyor belt (4*a* or 4*b*) is selectively displaceable toward or away from the other conveyor belt (4*a*, 4*b*) to adjust gap A, which may facilitate receiving objects 2 of different sizes.

As shown in FIG. 1A, conveyor belts 4*a*, 4*b* can include chain conveyors preferably having a rotating chain 40*a*, 40*b*, on which a gripping device 41*a*, 41*b* can be provided. Gripping device 41*a*, 41*b* preferably grips the trailing edges of objects 2 from behind, more specifically, upstream with respect to the flow of object 2 on conveyor belts 4*a*, 4*b*.

The embodiment of the system 1 shown in FIG. 1 can also include a holder 5 preferably constructed and arranged to retrieve object 2, preferably one at a time, from source 3. Holder 5 preferably retains object 2 in position while transferring object 2 from source 3 to destination 4. In the embodiment shown, holder 5 can include one or more holder heads 5*a*, which preferably include suction heads, which can provide a force, such as a vacuum force, on object 2. The force of holder heads 5*a* on object 2 preferably picks up and holds object 2 in place with respect to holder 5. A controlling mechanism can be provided for controlling the strength of the force exerted by holder heads 5*a*. Holder 5 preferably provides the handling of objects 2 over varying distances, whether short or long, between source 3 and destination 4 without requiring retooling system 1.

System 1 can also include a mover 6 constructed and arranged to move holder 5 from source 3 to destination 4 and preferably from destination 4 back to source 3, preferably seamlessly. As illustrated by the dashed lines in FIG. 1, the embodiment of holder 5 shown moves along a motion path 7 defined by holder 5 revolving about a first axis 8 and a second axis 9.

Referring to FIG. 1, a mover 6 or other mechanism can be provided to control the motion of holder 5 along path 7. Mover 6 can include a first arm 10, which rotates about a first axis 8. In the embodiment shown, first arm 10 has an elongated rod-like shape and first axis 8 is proximate a first end of first arm 10. However, it is to be understood that the shape and arrangement of first arm 10, the position of first axis 8, for example, with respect to first arm 8, etc. can be varied without deviating from the scope of the invention.

Mover 6 can also include a crank mechanism 11 having a crank wheel 11*a* and a crank arm 11*b* attached to crank wheel 11*a* such that as crank wheel 11*a* rotates, crank arm 11*b* revolves about crank wheel 11*a*. More preferably, crank arm 11*b* is pivotally connected to crank wheel 11*a* proximate the periphery of crank wheel 11*a* at crank pivot 11*c*. Crank arm 11*b* can be connected to first arm 10, more preferably, pivotally connected at a position between the two ends of first arm 10. Therefore, in accordance with the embodiment shown in FIG. 1, as crank wheel 11*a* rotates, crank arm 11*b* is pivotally displaced about crank wheel 11*a*, causing first arm 10 to pivot about first axis 8, first arm 10 being displaced along path H over an area $\alpha$. For example, starting at the position illustrated in FIG. 1, when crank wheel 11 a rotates in direction K, crank arm 11*b* can pull first arm 10 toward crank wheel 11*a* to pivot first arm 10 from first position H1 to second position H2. As crank wheel 11*a* rotates in the opposite direction, crank arm 11*b* can push first arm 10 away from crank wheel 11*a* to pivot first arm 10 from second position H2 to first position H1.

Mover 6 can also include a second arm 12 connected to one or more, preferably one holder 5. Holder 5 preferably extends laterally from second arm 12, more preferably perpendicularly to second arm 12. In the embodiment illustrated, mover 6 includes two second arms 12 extending in opposite direction to each other such that holders 5 are laterally reversed and are equidistant from second axis 9. Preferably, the respective holder heads 5*a* of second arms 12 are equidistant from second axis 9, and more preferably, the respective holder heads 5*b* of second arms 12 are also equidistant from second axis 9. More specifically, the two holders 5 can be arranged so as to have rotatable symmetry of 180°.

Second arm 12, as shown, can have an elongated rod shape and can be pivotally connected to first arm 10 at a second axis 9. Second axis 9 is preferably located proximate a second end of first arm 10 opposite from the first end of first arm 10 wherein first axis 8 is located. In accordance with an embodiment of the invention, second arm 12 is rotatable in a direction D about second axis 9. A second drive preferably rotates second arm 12 in direction D, the second drive being independent from the first drive, which controls first arm 10. Preferably, second arm 12 can rotate at least 360°, and more preferably can continuously rotate about second axis 9.

In accordance with an embodiment of the invention, source 3 can be provide at a relatively low height, such that the feeding height of objects 2 is relatively low, which may be ergonomically beneficial.

Figure 2:
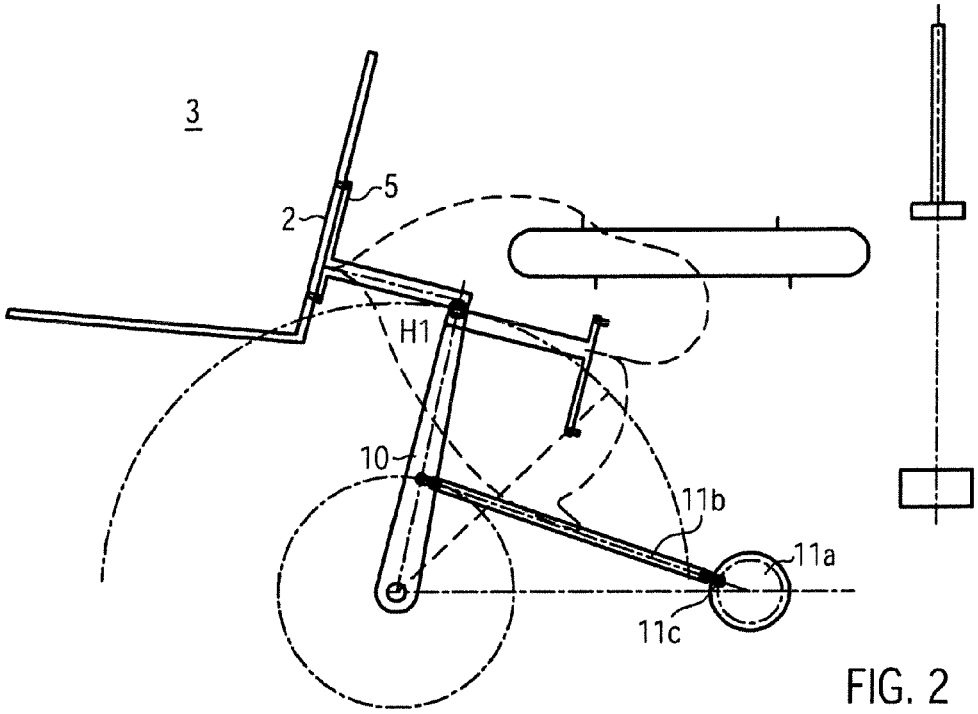
FIG. 2 is an enlarged view of area A of FIG. 1.

The operation of an embodiment of system 1 is illustrated in FIGS. 2 to 11. In accordance with the embodiment illustrated, FIG. 2 represents system 1 in a starting position, wherein holder 5 is located proximate source 3 to remove one object 2 from source 3. Preferably, holder 5 has a receiving surface positioned parallel to object 2, and second arm 12 extends perpendicularly to first arm 10 and object 2. As shown, crank mechanism 11 is in a position such that first arm 10 is in a first position H1. More preferably, the center of crank wheel 11*a* is aligned with crank arm 11*b* and crank pivot 11*c*. In the embodiment shown, crank pivot 11*c* is at a position closest to crank arm 11*b*.

Figure 3:
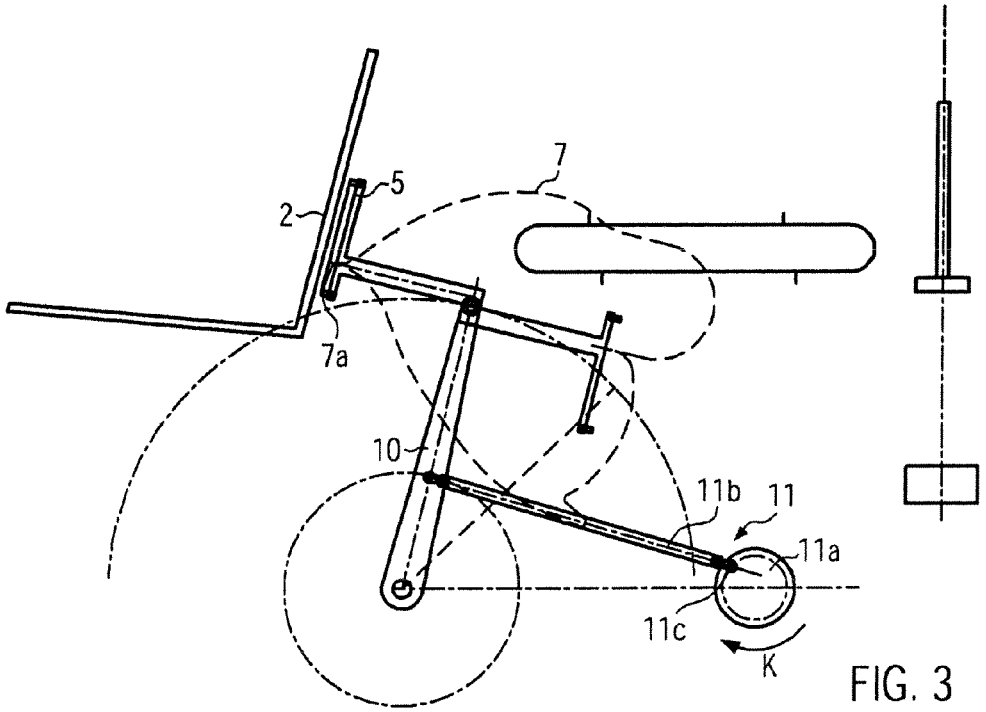
FIG. 3 is an enlarged view of area A of FIG. 1.

After holder 5 grasps object 2, for example, via suction force through holder heads 5*a*, 5*b*, the crank mechanism can be activated. More specifically, a drive can rotate crank wheel 11*a* in a crank direction K, as illustrated in FIG. 3. As crank wheel 11*a* rotates in crank direction K, crank pivot 11*c* can be displaced such that crank arm 11*b* is no longer aligned with the center of crank wheel 11*a*. First arm 10 can be displaced out of first position H1 in direction H. Second arm 12, and thus, holder 5, are preferably fixed with respect to first arm 10. Therefore, holder 5 preferably moves along a relatively straight line substantially perpendicular to the plane of object 2 on the side of object 2 grasped by holder 5. Thus, shearing, lateral force and friction exerted on object 2 as it is removed from source 3 is preferably minimized, more preferably eliminated. Rather, object 2 can be lifted off of source 3 in the direction of the stack of objects 2. This displacement motion is represented by reference number 7*a* in FIG. 3. Whereas motion 7*a* is described herein as being substantially straight, acceptable degrees of curvature are contemplated without deviating from the scope of the invention. Whereas it may be preferred to minimize the curvature resulting from the rotation, a curvature may result from the rotation of second arm 12 and second axis 9 about first axis 8. More specifically, the radius of curvature of the motion of second axis 9 about first axis 8 is preferably large enough to minimize, preferably prevent, the shearing, lateral force and friction exerted on object 2 as it is removed from source 3.

Figure 4:
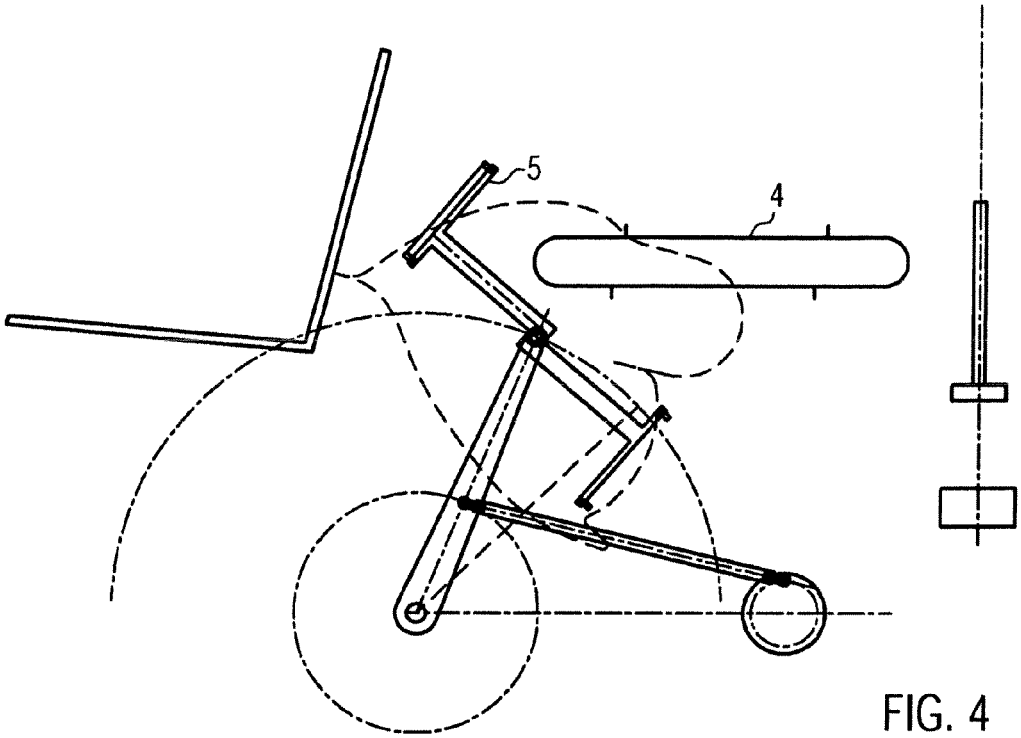
FIG. 4 is a side view of area A of FIG. 1.

Subsequently, once holder 5 has traveled portion 7*a* of path 7 and object 2 is removed from source 3, the drive for second arm 12 can be actuated such that second arm 12 can rotate about second axis 9. Preferably, first arm 10 continues to rotate toward second position H2 and second arm 12 rotates in direction D. More preferably, holder 5 moves toward destination 4, preferably above conveyor belts 4*a*, 4*b*. The movement of an embodiment of holder 5 is shown in FIGS. 4 and 5, wherein FIG. 5 represents a position subsequent to the position represented in FIG. 4.

Figure 5:
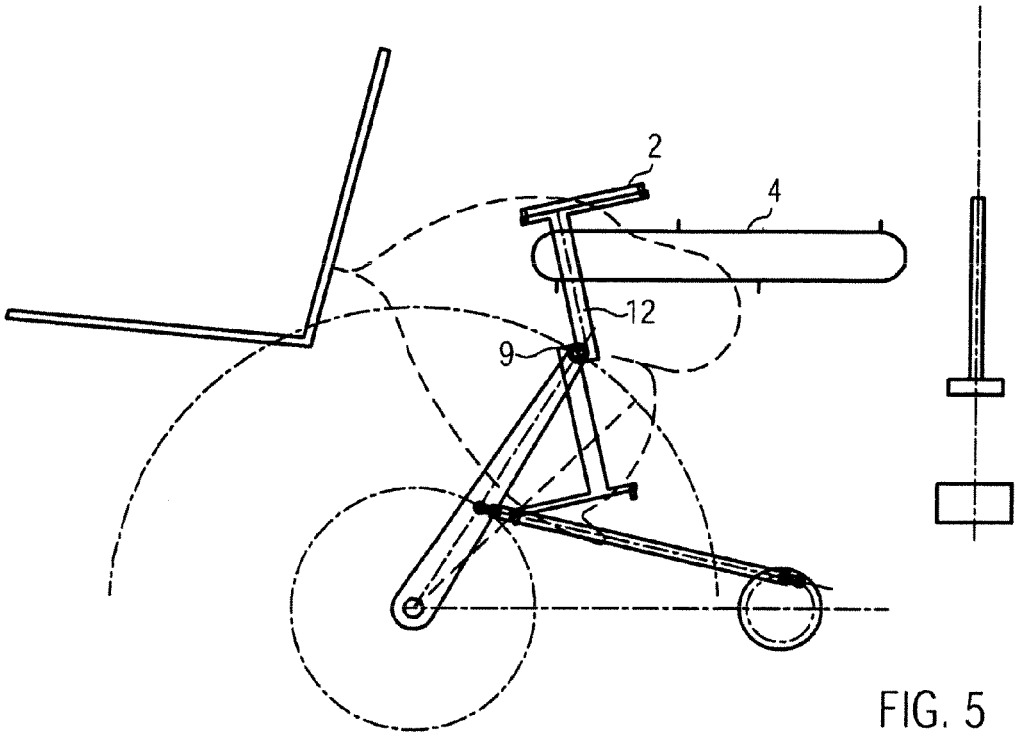
FIG. 5 is a top view of a gripper in a closed position in accordance with an embodiment of the invention.
Figure 6:
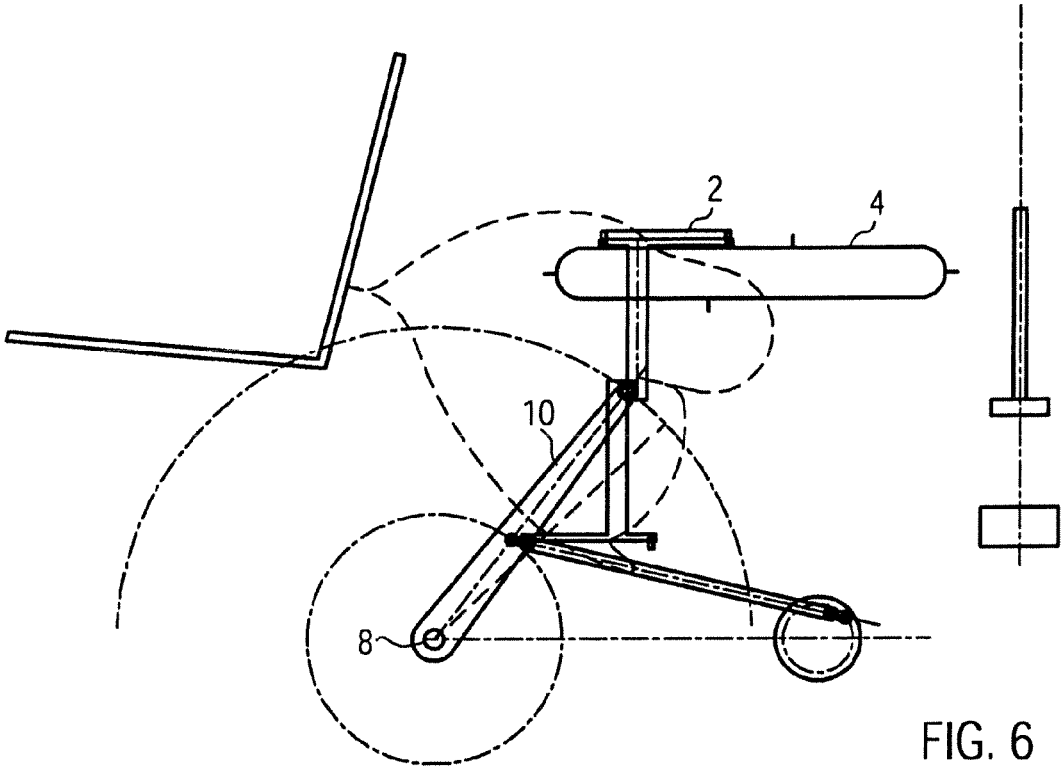
FIG. 6 is a top view of the gripper of FIG. 5 in a closed position.
Figure 7:
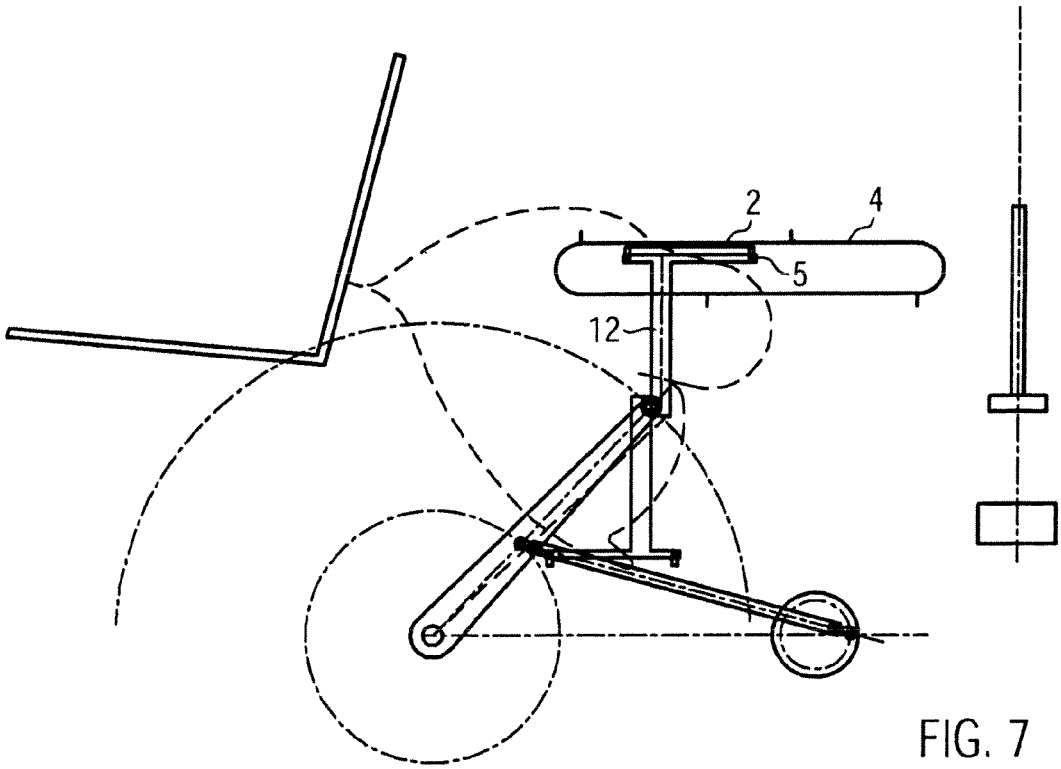
FIG. 7 is schematic depiction of the apparatus during a state of the operating procedure.

As shown in FIG. 5, path 7 of holder 5 can flatten proximate conveyor belts 4*a*, 4*b*. The slope of path 7 preferably increases proximate conveyor belts 4*a*, 4*b*, such that holder 5 moves downward toward conveyor belts 4*a*, 4*b*. Preferably, as illustrated in FIG. 6, holder 5 becomes substantially parallel to conveyor belts 4*a*, 4*b*. After holder 5 becomes parallel to conveyor belts 4*a*, 4*b*, second arm 12 is preferably prevented from rotating any further. For example, the drive of second arm 12 can be stopped. First arm 10 preferably continues to move in direction H toward second position H2 such that holder 5 moves along a path substantially perpendicular to conveyor belts 4*a*, 4*b*. Holder 5 is preferably displaced toward conveyor belts 4*a*, 4*b* until object 2 is above or contacts conveyor belts 4*a*, 4*b*, as shown in FIG. 7. An embodiment of this portion of path 7 is represented by reference number 7*b*.

Figure 8:
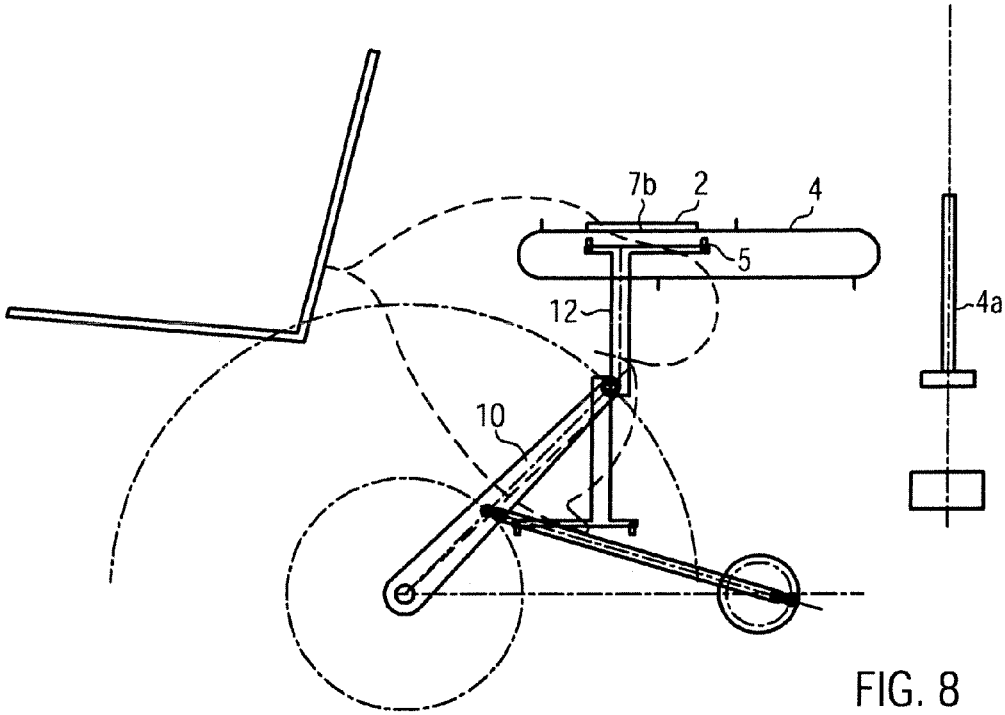
FIG. 8 is schematic depiction of the apparatus during another state of the operating procedure.

First arm 10 can continue rotating in direction H until it reaches second position H2. The drive for second arm 12 preferably remains stopped, such that second arm 12 does not pivot with respect to second axis 9. Rather, holder 5 and second arm 12 can revolve about first axis 8. Referring to FIG. 8, once object 2 contacts conveyor belts 4*a*, 4*b*, holder 5 preferably releases object 2 and object 2 is free to be conveyed on conveyor belts 4*a*, 4*b*. By way of non-limiting example, object 2 can be conveyed to a carton shaping and erecting machine 20.

Figure 9:
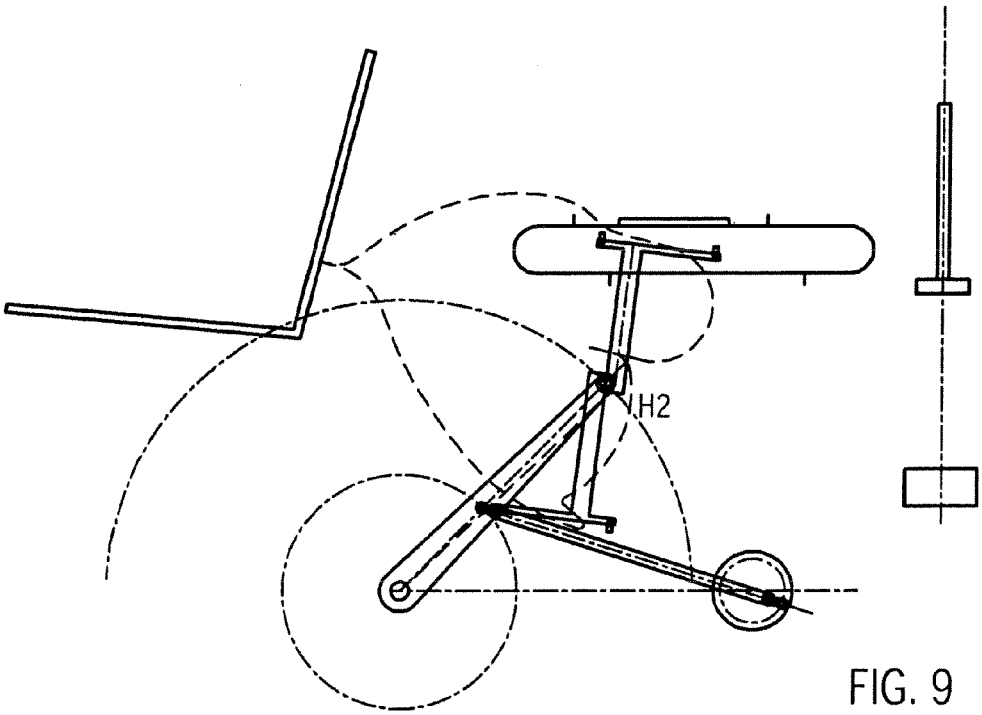
FIG. 9 is schematic depiction of the apparatus during another state of the operating procedure.
Figure 10:
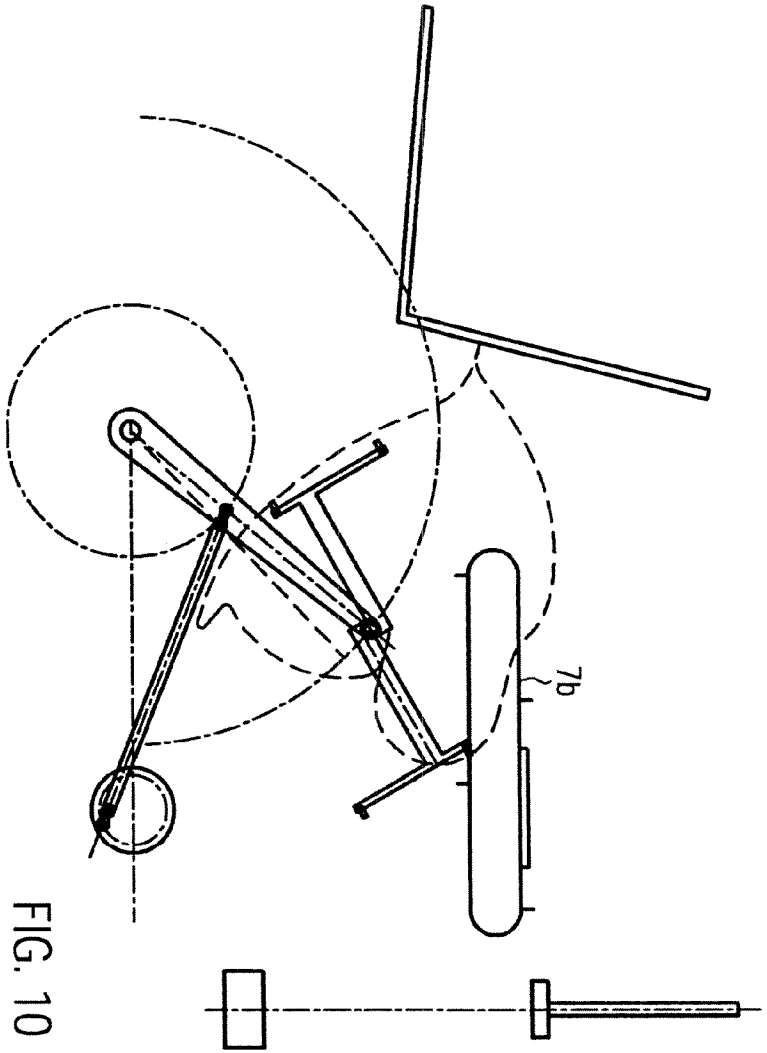
FIG. 10 is schematic depiction of the apparatus during another state of the operating procedure.
Figure 11:
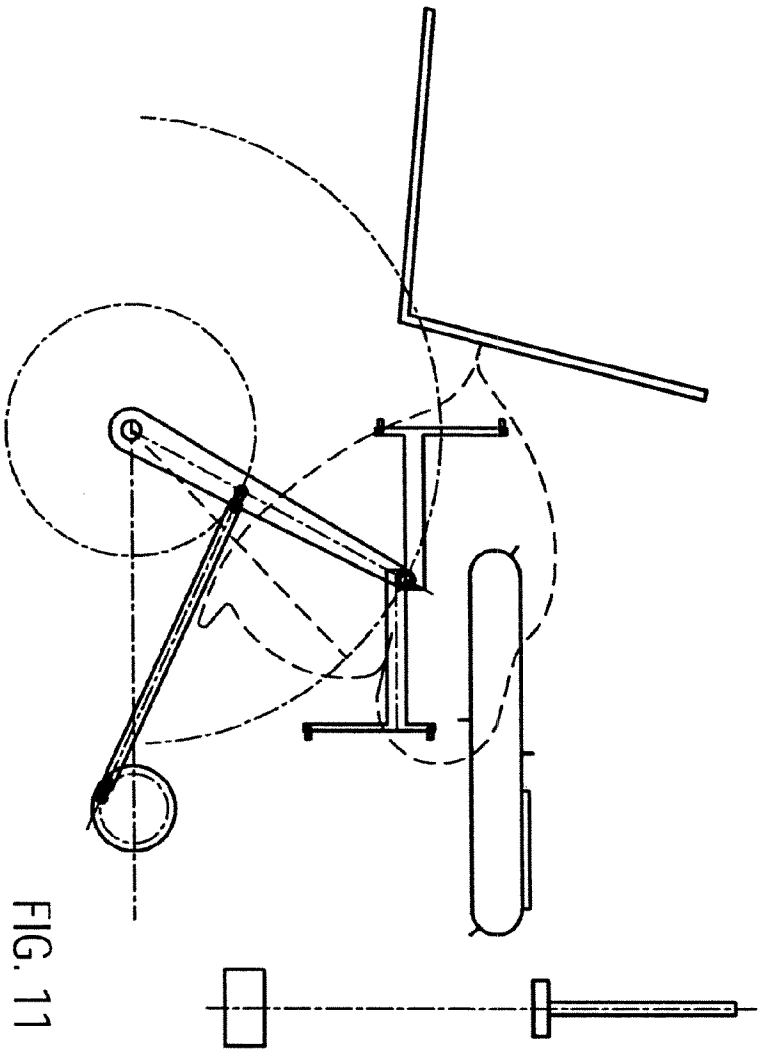
FIG. 11 is schematic depiction of the apparatus during another state of the procedure.

Referring to FIG. 9, once first arm 10 reaches second position H2, first arm 10 preferably travels back along path H toward first position H1. The drive for second arm 12 can be activated such that second arm 12 can pivot about second axis 9, preferably continuing to rotate in direction D. Preferably, the speed of rotation of an alternate second arm 12 is such that a second holder 5 approaches source 3 to grasp and transport object 2 from source 3 in a similar manner as that described above. FIGS. 10-11 illustrate two positions of holder 5 as holder 5 approaches the start position shown in FIG. 2.

By providing two or more axes, the process can be facilitated by enhancing high-speed rotation of arms 10, 12, and thus the transfer of objects 2. The axes preferably also provides reliable repeatability of the motion. By providing at least two axes, the straight-lined sections of path 7 can also be facilitated. Whereas mover 6 is described herein as including a crank mechanism having crank arm 11*b* pivotally connected to first arm 10, which is pivotally connected to second arm 12 connected to holder 5, it is to be understood that the construction and arrangement can be varied without deviating from the scope of the invention.

The examples provided are merely exemplary, as a matter of application specific to design choice, and should not be construed to limit the scope of the invention in any way.

Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, the grippers can include various mechanisms for receiving and retaining the container, by way on non-limiting example, suction mechanisms which can apply a suction force to receive and retain the container and stop the suction force to release the container. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

What is claimed is:

1. A system for transporting an object, the system comprising:

at least two holders, each holder constructed and arranged to selectively grasp, retain, and release an object having an object plane, wherein each holder defines a path from a source to a destination having a receiving surface, wherein the path includes a first straight portion as the object is removed from the source, the first straight portion extending perpendicularly to the object plane, and a second straight portion as the object is released onto the receiving surface, the second straight portion crossing the receiving surface;

each holder is constructed and arranged to selectively release the object onto the receiving surface when the holder is on the same level as the receiving surface and the holder is capable of descending under the receiving surface after releasing the object; and a mover constructed and arranged to move the at least two holders, wherein the mover includes a first arm rotatable about a first axis and at least one second arm rotatable about a second axis, wherein the at least one second arm is attached to at least one of the at least two holders extending in opposite directions from the second axis.

2. The system of claim 1, wherein each holder rotates about the first axis and the second axis.

3. The system of claim 1, wherein the first straight portion of the path is defined by the rotation of each holder about the first axis.

4. The system of claim 1, wherein a second straight portion of the path is defined by the rotation of each holder about the first axis.

5. The system of claim 1, wherein the second axis is located a distance from the first axis.

6. The system of claim 1, wherein each second arm is rotatable by at least 360 degrees about the second axis.

7. The system of claim 1, wherein the first arm pivots back and forth between two positions.

8. The system of claim 1, wherein the first arm and each second arm is controlled independently of each other.

9. The system of claim 1, wherein the at least one second arm is pivotally connected to the first arm.

* * * * *